US008015771B2

(12) United States Patent
LeBlang

(10) Patent No.: US 8,015,771 B2
(45) Date of Patent: Sep. 13, 2011

(54) BUILDING FORM FOR CONCRETE FLOORS, WALLS AND BEAMS

(76) Inventor: Dennis William LeBlang, Indio, CA (US)

( * ) Notice: Subject to any disclaimer, the term of this patent is extended or adjusted under 35 U.S.C. 154(b) by 164 days.

(21) Appl. No.: 12/214,777

(22) Filed: Jun. 23, 2008

(65) Prior Publication Data

US 2009/0199500 A1 Aug. 13, 2009

Related U.S. Application Data

(60) Provisional application No. 61/065,236, filed on Feb. 11, 2008.

(51) Int. Cl.
*E04B 1/18* (2006.01)

(52) U.S. Cl. ..... 52/414; 52/336

(58) Field of Classification Search ..... 52/649.2, 52/414, 252, 309.12, 336
See application file for complete search history.

(56) References Cited

U.S. PATENT DOCUMENTS

| | | | | |
|---|---|---|---|---|
| 4,120,131 | A * | 10/1978 | Carroll | 52/310 |
| 4,685,264 | A * | 8/1987 | Landis | 52/252 |
| 5,930,965 | A * | 8/1999 | Carver | 52/320 |
| 6,041,561 | A | 3/2000 | LeBlang | |
| 6,298,622 | B1 | 10/2001 | Cretti | |
| 6,401,417 | B1 | 6/2002 | LeBlang | |
| 6,541,097 | B2 | 4/2003 | Lynch | |
| 6,584,742 | B1 | 7/2003 | Kilgier | |
| 6,698,148 | B1 * | 3/2004 | Manna et al. | 52/302.1 |
| 6,737,115 | B2 | 5/2004 | Griesbach | |
| 6,817,150 | B1 | 11/2004 | Boeshart | |
| 7,232,605 | B2 | 6/2007 | Burgueno | |
| 7,255,765 | B2 | 8/2007 | Ruggle | |
| 2005/0229536 | A1 * | 10/2005 | Yoshii et al. | 52/783.11 |
| 2006/0251851 | A1 | 11/2006 | Bowman | |
| 2007/0044392 | A1 | 3/2007 | LeBlang | |
| 2007/0074804 | A1 | 4/2007 | Amend | |
| 2008/0010943 | A1 | 1/2008 | Marschke | |
| 2008/0041004 | A1 | 2/2008 | Gibbar | |

FOREIGN PATENT DOCUMENTS

GB 393537 A * 10/1933

* cited by examiner

*Primary Examiner* — Eileen D Lillis
*Assistant Examiner* — Branon Painter

(57) ABSTRACT

A building form that uses two building panels made of a rigid board and rigid insulation are supported by light gauge framing members and integrating two adjacent building panel molds forming a ribbed chamber into which concrete can be poured. The building panels when jointed together form a depression within the mold panel for a concrete rib when concrete is poured over the building panels. In addition, each of the building panels when separated by another fire resistant board thereby forming a space between the panel molds forming a wider forming mold which becomes an integral part of the building panel. The separated building panels also allow for mechanical means to be distributed. Additional forming means can be added for a wider and deeper forming structure. Several different transverse support beams can be used to increase the panel mold structural strength.

14 Claims, 5 Drawing Sheets

BUILDING FORM FOR CONCRETE FLOORS, WALLS AND BEAMS

CROSS REFERENCE TO RELATED APPLICATIONS

A provisional patent application No. 61/065,236 was filed on Feb. 11, 2008 and this date should be used as the filling date for this application. In addition a patent pending application U.S. Ser. No. 10/988,030 was filed on Nov. 12, 2004 by LeBlang. On Jun. 11, 2009 LeBlang filed PCT/US2009/003500 which is also entitled "A Building Form for Concrete Floor, Walls & Beams".

BACKGROUND OF THE INVENTION (1) Field of the Invention

The present invention relates to an improved poured concrete floor, wall or roof form system where the size of the concrete rib can easily vary in size plus the panel system has a fire rating assembly built into the forming system. Different types of materials can be used interchangeably without changing the integrity of the concrete structure as well as the method to fabricate a building panel and transverse beam.

(2) Background of the Invention

It is well known in the industry that light gauge metal framing is used to support floors, more typically by attaching plywood to the top flange of the metal framing channel. Then if a concrete floor was desired, a thin concrete topping was installed over the plywood.

Another method to create a concrete floor was to install portable forms using temporary bracing to support the portable forms. The concrete hardens then the temporary forms and shoring are removed thereby creating a concrete floor and an exposed concrete ceiling below the floor.

There are several floor forming systems that are presently on the market that are made of polystyrene and metal channels. These panels are a polystyrene mold used to support a concrete floor or concrete wall panel until the concrete has cured. The concrete material and its structural steel reinforcing is the structural result of using the polystyrene forms. The forms are made so that a ribbed concrete configuration will result. These existing panels are basically manufactured where a metal support channel is embedded in the thicker middle section of the polystyrene or in some cases two metal supports are installed within the panel. The metal channels support the expanded polystyrene and the concrete until the concrete has cured.

In some cases the metal channel is molded into the polystyrene, other times the metal channel is slid into the polystyrene at the thicker interior section of the panel. In another case the polystyrene fits over the metal channels again at the thicker polystyrene section of the panel.

Initially LeBlang in U.S. Pat. No. 6,041,561 showed a floor or wall constructed on metal channels and rigid insulation with intermediate crossing beams within the wall/floor structures using rigid insulation or rigid board as additional support until the concrete has cured. In addition isolated beams and columns are shown using light gauge metal framing and other beams are shown using steel bar joists as a forming structure.

Later PCT/EP97/05671 was converted to U.S. Pat. No. 6,298,622, by Cretti has embedded metal channels within expanded plastic material to support a concrete floor until the concrete has cured. The expanded plastic material is extruded with the steel studs embedded therein. The panels are interconnected to form a floor upon which concrete is cast. In addition lath is installed to the flange of the metal channels and plaster material is installed over the metal lath to create a fire resistant underside of the floor construction.

Soon thereafter Boeshart in U.S. Pat. No. 6,817,150 improved on Plastedil patent by adding layer of expanded polystyrene material to increase the depth of the concrete ribs without having to remake a panel as well as used oblique sidewalls to better secure the expanded polystyrene to the concrete ribs.

Later LeBlang in US 2007/0044392 shows a floor system supported by two light gauge metal channels back to back or an H channel. The flanges of the channels support a rigid board or an expanded polystyrene material. An additional layer of expanded polystyrene is then added on top of the rigid board forming the ribbed concrete flooring mold. The metal channels penetrate the rigid insulation, allowing the light gauge metal support channels to support a flooring system until the concrete has cured.

Two years later US 2006/0251851 by Bowman embeds a portion of the light gauge metal framing into the expanded polymer with the metal framing exposed above and/or below the expanded polymer. Later that same year in US 2008/0041004 by Gibbar, shows metal channels supporting polymer foam to form a concrete ribbed system. Then later that same year Amend in US 2007/0074804 embeds a brace within the polymer foam to give strength to the expanded polymer. The light gauge metal channels support the embedded brace within the foam adding additional support to the foam.

One thing all these panels have in common is that the metal channels support the polystyrene and the polystyrene supports a floor rib by the narrow polystyrene support of the panel. The weight of the concrete at the rib section of the panel is the thickest and therefore the heaviest. All of these existing panels support the heaviest portion or the rib section with only the polystyrene and not the metal channel.

Typically the existing polystyrene panels are not protected from fire. The polystyrene and the metal channels are exposed to any type of fire or explosions within the building. Polystyrene is flammable and does melt until extreme heat or fire. The building codes require that the polystyrene molds be protected, that is add drywall or spray on fireproofing to reduce smoke and fire within a building. In other words, the existing patents require additional materials to be added to within a building to reduce the public health and safety issues within our building codes.

In addition to the floor/wall panel mold, these various floor panel molds can be supported by the light gauge framing beams or the steel bar joists as shown in the LeBlang patent U.S. Pat. No. 6,041,561. The depth of the beam can be extended when using light gauge framing or bar joists as an extension of the floor forming system.

Not all molds panels use polystyrene as the molding structure. For example, inventor Marschke has developed many machines to make cardboard. Later in a pending patent, Marschke in US 2008/0010943 uses an open core element made of fluted paper and an upper and lower sheet as a forming structure for concrete overlayment. A post tension system is used to support the floor as well as wood embedded within the core element. Other structural steel elements are used to support the fluted paper structure. A foam core can also be applied to the open cores of the fluted paper.

Another wood-based product is shown in U.S. Pat. No. 6,541,097 by Lynch for Masonite Corporation developed a ribbed high density fibreboard product that can be used as decking or packaging. The product is structurally support by exposed wood beams. Later in U.S. Pat. No. 7,255,765 by Ruggle shows the ribbed high density fibreboard installed with a layer above and below, therefore making a more rigid cardboard.

Another application using fiberboard in a panel application is in U.S. Pat. No. 6,737,115 by Griesbach uses a slurry to produce diagonal bands in the panel to stiffen and reinforce the panel. On the other hand U.S. Pat. No. 6,584,742 by Kilgier uses metal channels and strand board at the interior with inner and outer facing layers.

The materials being produced today are getting more sophisticated for example U.S. Pat. No. 7,232,605 by Burgueno is a hybrid natural-fiber composite panel with cellular skeleton tubular openings. The hybrid natural-fiber panel also has a greater strength than other types of products.

BRIEF SUMMARY OF THE INVENTION

The general object of the present invention is to provide a better ribbed concrete floor, wall or roof structure by using a stronger and more fire resistant forming system. A further object is to provide a more versatile form allowing for more flexibility in the field and one allowing ease in installing other utilities within the building system as well as a broader range of materials used to create a better forming system. The system also allows for reduced shoring below the floor system, since the metal framing members are directly adjacent to the concrete rib within the floor. Another object is to provide a stay-in-place beam forming system connecting the ribbed concrete flooring sections.

From a structural aspect, in a ribbed concrete floor the most concrete is at the ribbed area of the concrete floor and therefore when the concrete is wet and not cured the heaviest load is located at the concrete rib. Therefore by placing the metal support channel at the concrete rib section of the panel, the polystyrene rigid insulation and rigid board below will not deflect and therefore support a greater load and therefore fewer temporary braces are required below the flooring system.

A typical panel has two metal C channels that are parallel to each other with a polystyrene core between the channels. The web of each of the C channels is the outer edge of the longitudinal side of the panel. The flanges of each of the C channels faces inwardly toward each other forming a ledge to support a rigid board between the C channels. Polystyrene is then installed between the C channels and above the rigid board. The polystyrene is molded to the desired thickness of the panel and notched out above the C channel. The notch can either be obtained by molding the polystyrene into the desire shape or cutting the polystyrene to the desire shape after the panel is molded. The rigid board can be a concrete board or drywall material or other fire resistant materials. The rigid board also becomes a panel mold for forming the polystyrene shape as well as the fire resistant material on the bottom of the forming panel.

Since light gauge metal and the rigid boards are the structural supporting members of the panel molds, a non-structural foam or corrugated paper can be used to as form filler support of the panel mold. In fact a material like straw could even be used as a filler in lieu of the rigid insulation described below to support the concrete ribbed floor. Many different types of rigid board can be used like drywall, concrete board, fiber cement board, ribbed fiber board as well as forming a panel using a fiber cement skin. This skin would be poured in place at a factory and the foam core or other product would be added prior to the concrete curing. The rigid board doesn't really have to be a rigid board, but a light gauge ribbed metal decking. Based on the type of panel construction, different building materials can be used interchangeably based on the panel requirements.

DETAIL DESCRIPTION OF THE INVENTION

Figure 1:
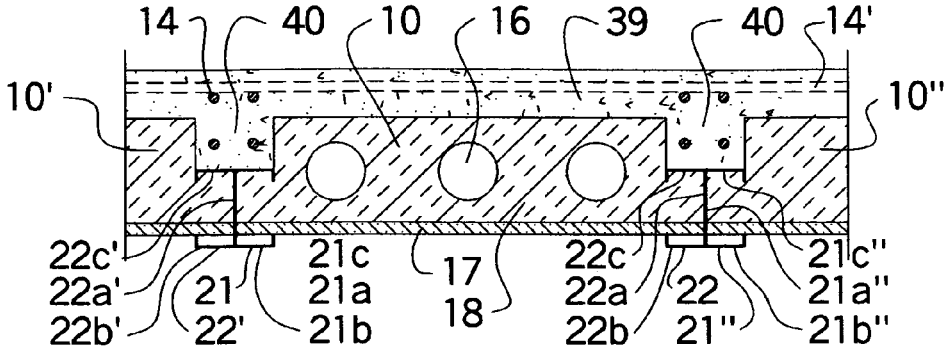
FIG. 1 shows a typical floor section between floor braces showing the cross section of the concrete rib.

After review of the existing and pending patents, one can immediately see the differences in this patent application. In FIG. 1 the drawings show panel mold 10 and two partial panel molds 10' and 10". The panel molds when joined together form a continuous surface onto which concrete 40 can be poured to form a floor or a wall. The size of a concrete rib depends on the structural requirements of the floor span required or the height or wind load of a wall.

FIG. 1 shows a panel mold 10 consisting of two panel mold support members, a C channel 21 on the left side and another C channel 22 on the right side of the panel mold. Each of the C channels 21 & 22 consists of a web 21*a* & 22*a* and a lower flange 21*b* & 22*b* plus an upper flange 21*c* & 22*c*. The C channels 21 & 22 are turned so that the lower flange 21*b* and 22*b* support a rigid board 17 between the channels 21 and 22 therefore the webs 21*a* & 22*a* are the outer edges of the panel mold 10. A form filler of rigid insulation 18 is installed between on the rigid board 17 between the C channel webs 21*a* and 22*a* and extend above the upper flanges 21*c* and 22*c* to the desire depth of a concrete rib 40.

A concrete rib 40 is formed when panel mold 10 and 10' are placed adjacent to one another, that is, when the C channel 22' of panel mold 10' abuts the C channel 21 of panel mold 10. Since the C channels 21 & 22' do abut each other, their webs 22*a*' and 22*a* are touching. The width of a concrete rib 40 is determined by adding the width of the upper flange 22*c*' and

Figure 1A:
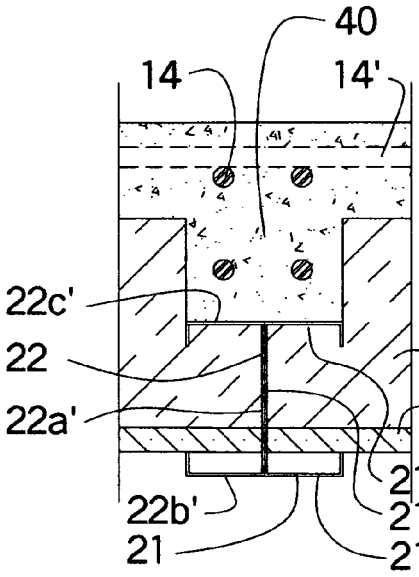

21*c* together and the height is determined by the thickness of the rigid insulation 18. Utility distribution can be installed within the holes 16 of the rigid insulation 18. The holes 16 can be cut adjacent to the rigid board 17 for ease of manufacturing and parallel to the C channels 22 and 23 within panel mold 10. The holes 16 can be located adjacent to the rigid board 17 since the rigid board 17 is the main support for supporting the concrete 39 until the concrete 39 cures. Additional steel reinforcing bars 14 are added within the concrete rib 40. Additional reinforcing steel 14' can be added perpendicular to the reinforcing steel 14 in the concrete rib 40. The size of the C channels 21 & 22 are dependent on the gauge and size of the metal channels 21 & 22 as well as the distance they are required to span. Additional temporary bracing (not shown) is required below the panel mold 10 if the size of the C channels 21 & 22 are not strong enough to support the weight of the wet concrete 39. After the temporary bracing and steel reinforcing is installed, concrete 39 is ready to be installed within the panel molds 10, 10' & 10". FIG. 1*a* shows an enlarged section of the left concrete rib 40 shown between the panel mold 10 & 10'.

Figure 2A:
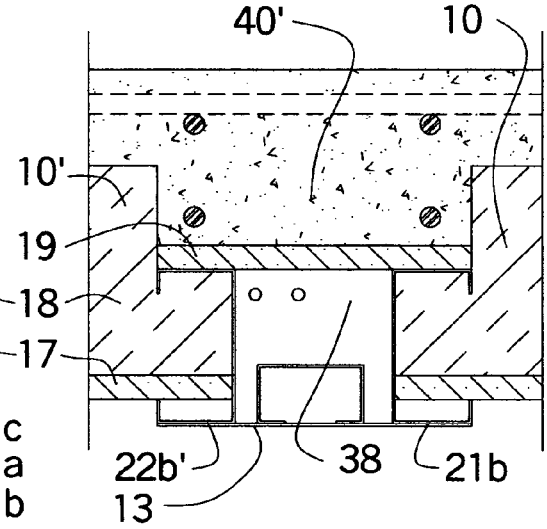
FIG. 2 shows the typical floor section with a space between the floor braces allowing for a wider concrete rib and utility distribution area.
Figure 2:
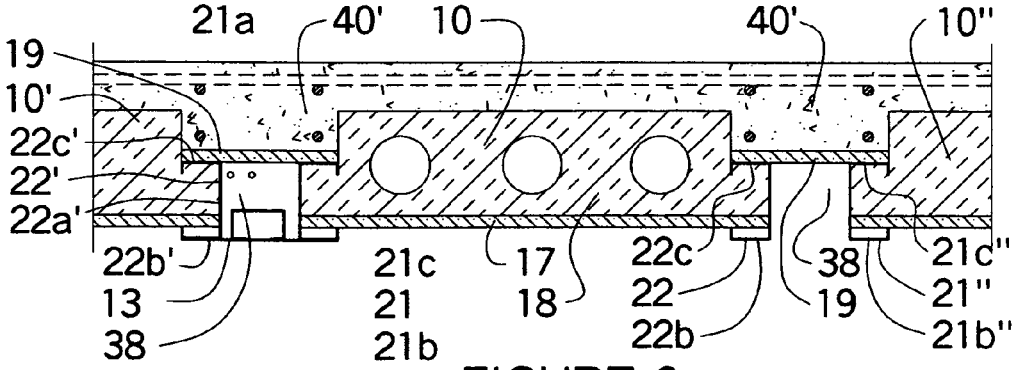

The configuration of panel molds 10, 10' & 10" are exactly the same in FIG. 2, except the panel molds 10 & 10' plus 10 & 10" are separated leaving a utility chase located between the C channel 22' & 21 and between C channel 22 & 21". The concrete rib 40' is the same size on both the left side and right side of the drawing. The concrete rib 40' on the right side is supported by the rib board 19 and the upper flanges of 22*c* and 21*c"* of the C channels 22 & 21" respectively. The rib board 19 between each panel is the bottom of the mold of the concrete rib 40'. Since the rib board 19 is totally independent of the panel molds 10 and 10" the width of the concrete rib 40' can be an size depending on the structural requirements of the concrete rib 40'. The left concrete rib 40' shows a cover plate 13 can be installed under the lower flanges 22*b'* & 21*b* as shown at left as a utility chase 38 and also shown in FIG. 2*a*. Since each of the panel molds are separated by the utility chase 38, the opening between the C channel 22' & 21 plus between C channels 22 & 22" can have electricity, plumbing, telephone, i.e. distributed as well as accessible but yet concealed between panel molds without being exposed under the panel molds.

Figure 3:
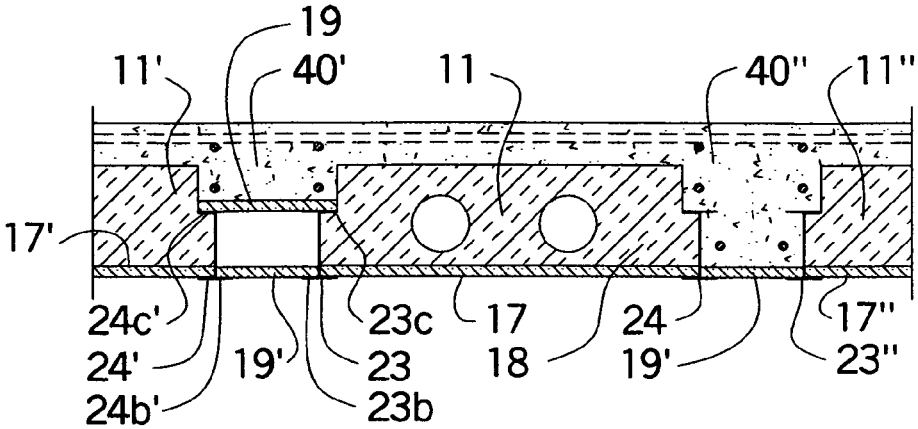
FIG. 3 shows the typical floor section with a space between the floor braces, however an H brace is used and a concrete is deeper.

FIG. 3 is similar to FIG. 2, except here H channels 23 & 24 are used as the panel mold support members on both the left side and right side of the panel mold 11. The left concrete rib 40' is the same as in FIG. 2 except here a rib board 19 rests upon the top flange 24*c'* & 23*c* of the H channels 24' & 23. Because the panel mold support members are H channels, the lower flange 24*b'* supports a hard board 17 of panel mold 11' and a smaller rib support 19' between the opposite lower flange 23*a* and the hard board 17 of panel mold 11. The right concrete rib 40" has a greater depth because the concrete rib 40" is supported on the smaller rib support 19'. FIG. 3 does show the H channels as described above, however two back to back U channels (not shown) could also be used to serve the same supporting function.

The flanges of any of the C channels or H channels allows for the hard board 17 or rib supports 19' to be attached by gravity or glue if desired to create the panels.

Figure 4:
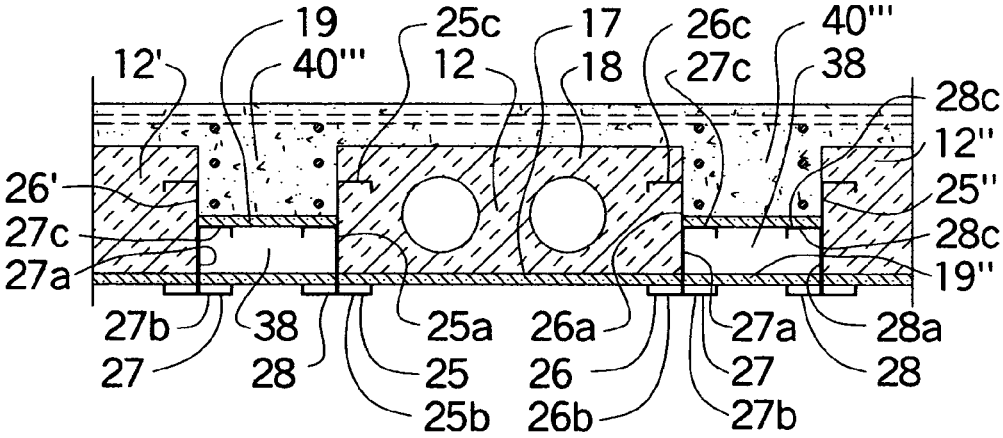
FIG. 4 shows a deeper ribbed concrete floor using two different size braces and still maintain the utility distribution under the concrete rib.

FIG. 4 shows a larger concrete rib 40'" than the previous figures discussed. The panel mold 12 has two deeper panel mold support members shown as C channels 25 & 26, which are installed at the sides of the panel mold 12 where the webs 25*a* & 26*a* define the edge of the panel mold 12. The lower flanges 25*b* & 26*a* support the hard board 17 and the rigid insulation 18 above is also thicker. The upper flange 25*c* & 26*c* of the C channels 25 & 26 are embedded into the rigid insulation 18. A large concrete rib 40' is formed when panel mold 12 and panel mold 12' & 12" are placed near panel mold 12. Additional beam mold support members shown as C channels 27 & 28 are installed between panel mold 12' and panel mold 12 as well as between panel mold 12 and panel mold 12". The web 27*a* is adjacent to web 26*a* at the right larger concrete rib 40' and web 28*a* is adjacent to 25*a"*. The top flanges of 27*c* & 28*c* support the rib board 19, which is the bottom of the concrete rib 40'. Another rib board 19" can be installed between the lower flange 27*b* & 28*b* creating a utility chase 38 below the large concrete rib 40'". The C channel 27 can be attached to panel mold 12 and C channel 28 can be attached to panel mold 12" or can be installed loosed at the construction site. The rib boards 19 & 19" are installed after the panels 12, 12' & 12" are installed. By installing the rib boards 19 & 19" at the job site, the size of the concrete rib 40" can be flexible in size.

Figure 5:
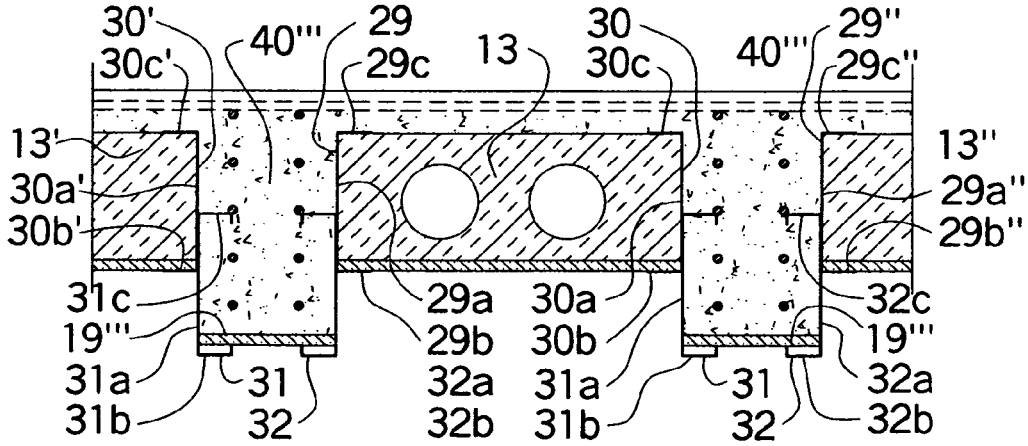
FIG. 5 shows an even deeper ribbed concrete floor using two different size braces, but eliminating the utility distribution under the concrete rib.

The FIG. 5 panel molds 13, 13' & 13" are made similar to FIG. 4, however the panel mold support members shown as U channels 29 & 30 encase the sides of panel mold 13. The lower flange 29*b* and 30*b* supports the rigid board 17 and the webs 29*a* & 30*a* define the sides of panel mold 13. The rigid insulation 18 is installed above the rigid board 17 to the height of the upper flange 29*c* & 30*c* of the U channels 29 & 30. Once the height and width of a concrete rib is determined, the beam mold support members shown as C channels 31 & 32 can be attached to the sides of the panel mold 13. Therefore web 31*a* of C channel 31 is attached to the web 29*a* of U channel 29 and set to the desire height of the concrete rib 40'" plus the web 32*a* of C channel 32 is attached to the web 30*a* of U channel 30. The width of the concrete rib 40'" can be any dimension depending on the structural requirements required to support a floor or the height of any wall. The lower flange 31*b* and 32*b* form a shelf where the 19'" rib board rests form the lower edge of the concrete rib 40"".

The different configuration of the floor system also requires transverse beams which are formed when the flooring system intersects a crossing beam known as a transverse beam. The transverse beams are usually larger in size than a typical concrete rib within the flooring system. The floor system had several different types of panel mold support members. These panel mold support members for example are shown in FIGS. 1 & 2 as C channel 23 & 24. In FIG. 3 the panel mold support members were the H channels 23 & 24 and in FIG. 4 the C channels 25, 26, 27 & 28.

Figure 6:
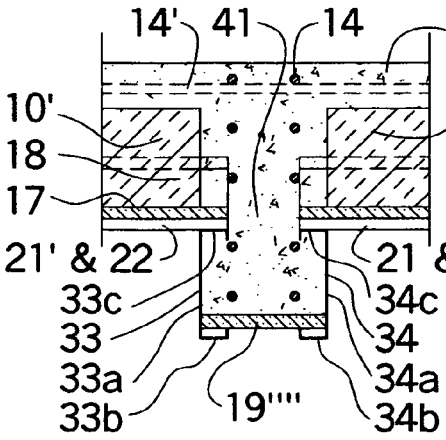
FIG. 6 shows a transverse concrete beam between two ribbed concrete floor sections.

FIG. 6 shows two transverse support members shown as C channels 33 & 34 and are separated by a rib board 19"" that rests on the lower flange 33*b* of channel 33 and the lower flange 34*b* of C channel 34. The web 33*a* and 34*a* define the width of the transverse beam 41. The transverse beam 41 is also formed when panel molds 10' is supported by framing C channels 21' & 22' and rest on the upper flange 33*c* of the transverse support members, plus the floor panel mold 10 is supported by the panel mold support members shown as C channels 21 & 22 and rest on the upper flange 34*c* of the transverse support members. The rigid insulation 18 and the rigid board 17 of both panel molds 10 & 10' are trimmed to align with the webs of the C channels 33 & 34 forming the transverse beam 41. Additional reinforcing steel 14 is installed in the transverse beam 41 and in the concrete 39 of the rib molds within of the panel molds 10 & 10'. Temporary bracing (not shown) is installed below panel molds 10 & 10' and the transverse beam 41 prior to installing concrete 39 over the molds 10 & 10' and into the transverse beam 41.

Figure 7:
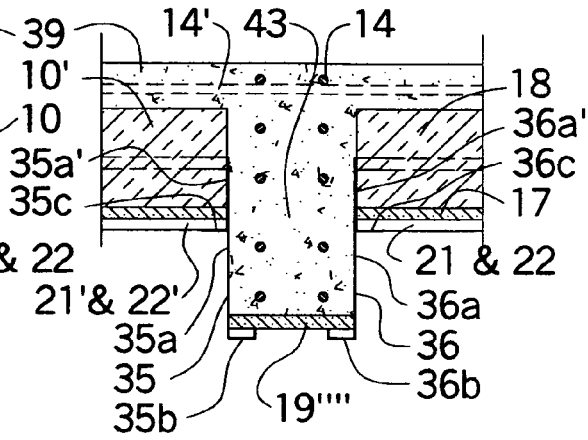
FIG. 7 shows a different transverse concrete beam between two ribbed concrete floor sections, however the supporting transverse beam members are deeper.
Figure 7A:
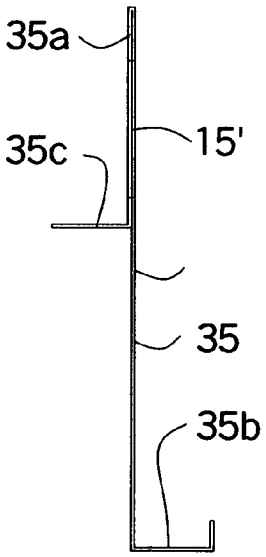
Figure 8:
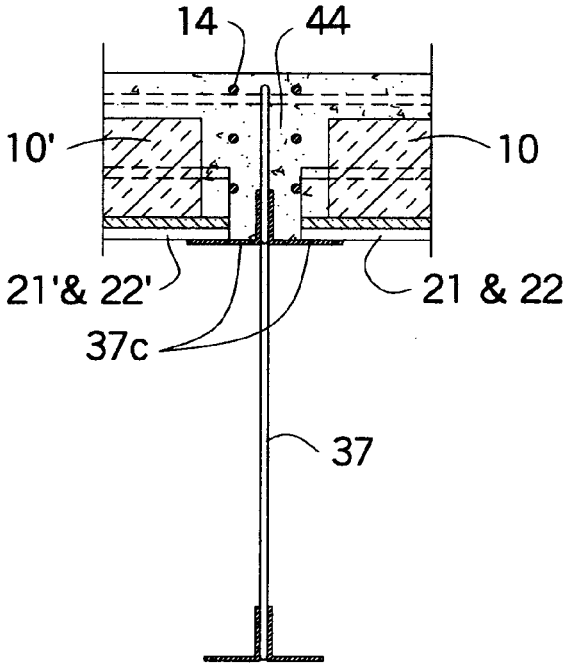
FIG. 8 shows a transverse beam member as a bar joist is used rather than light gauge metal framing.

The transverse beam 43 in FIG. 7 is similar to the transverse beam 41 in FIG. 6 except here the transverse support members are shown as J channels 35 & 36. FIG. 7*a* shows an enlarged drawing of the J channel 35, where the top flange 35*c* supports the panel mold support members shown as C channels 21' & 22' of panel mold 10' rest on this top flange 35*c*. The web 35*a*' extends above the top flange 35*c* and the web 35*a* extends downward to the lower flange 35*b* which defines the bottom of the transverse beam 43. The web 35*a* also extends above the top flange 35*c* in order to increase the structural capabilities of the transverse support channels 33 & 34 in FIG. 6. The web 35*a*' has holes 16 and are aligned with the holes 16 of the web 35*a*. The transverse support channel 36 is a mirror image of transverse support channel 35. The C channels 21 & 22 of panel mold 10 rest on the upper flange 36*c* of the transverse support channel 36. The rib board 19"" rests on the lower flange of 35*b* & 36*b*. To increase strength of the transverse beam 43 additional reinforcing steel 14 is added to the interior of the transverse beam 43. The rigid board 17 of both the panel mold 10' & 10 extend to the transverse support channels 35 & 36 while the rigid insulation is shown A smaller transverse beam 44 is installed in FIG. 8, where a steel-bar joist 37 is used as a transverse support member between the panel mold 10 & 10'. The panel mold support members 21' & 22' of panel mold 10' and the panel mold support member 21 & 22 of panel mold 10 rest on the top chord 37*c* of the steel bar joist 37. The space between the panel molds 10' & 10 and the top chord 37*c* of the steel bar joist 37 is the area of transverse beam 44. Additional steel reinforcing bars 14 are installed parallel to the steel bar joist 37.

Figure 9:
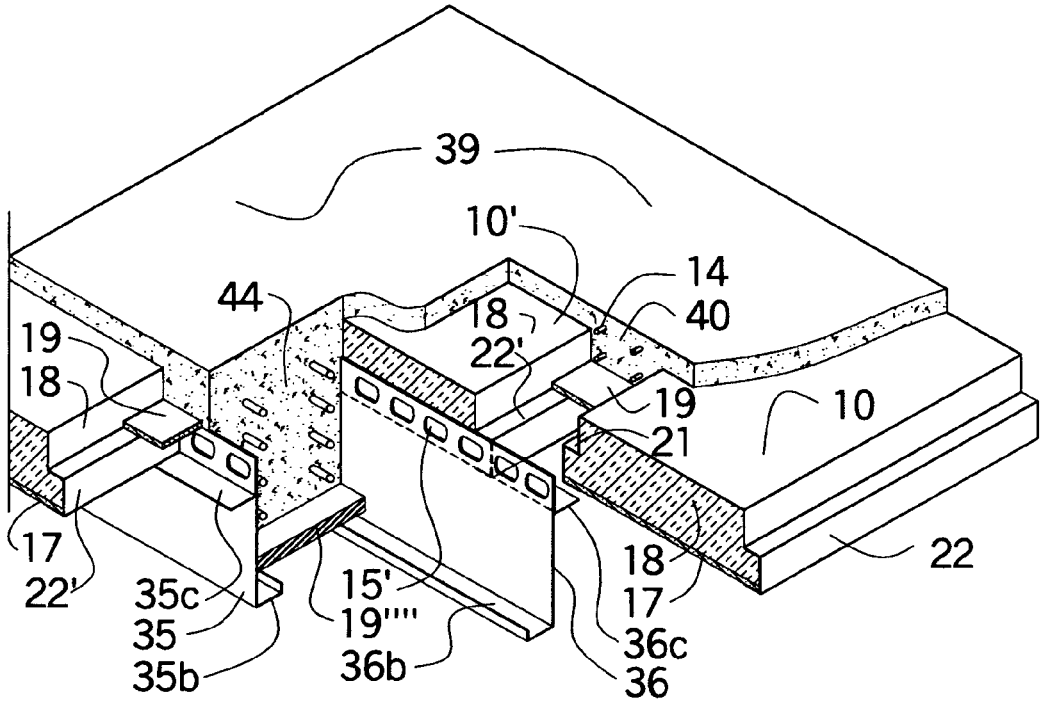
FIG. 9 shows an isometric drawing of the typical concrete ribbed floor with the transverse beam using light gauge metal framing.

FIG. 9 shows an isometric view of the transverse beam 44 similar to the transverse beam 41 shown in FIG. 7 and the intersecting panel molds 10' & 10. The panel mold support members shown as C channels 21' (not shown) & 22' of panel molds 10' and the panel mold support members shown as C channels 21 & 22 of panel molds 10 rest on the transverse support channel 36 at the upper flange 36*c*. The panel molds 10' & 10 have the hard board 17 supported by the lower flanges 21*b*' & 22*b*' plus 21*b* & 22*b*. The concrete rib beam 40 between the panel molds 10' & 10 are supported by the rib board 19. The same panel molds 10' (partially shown & 10 (not shown) rest on the upper flange 35*c* of the transverse support channel 35. When the two transverse support channels 35 & 36 are set in place the rib board 19"" is installed on the lower flanges 35*b* & 36*b* of the transverse support channels 35 & 36. Holes 16 are located in the transverse support channels 35 & 36 which allow the steel reinforcing 14 and concrete 39 to pass through. Additional reinforcing steel 14 in the transverse beam 44 is installed and connected to the reinforcing steel 14 in the concrete rib 40.

Figure 10:
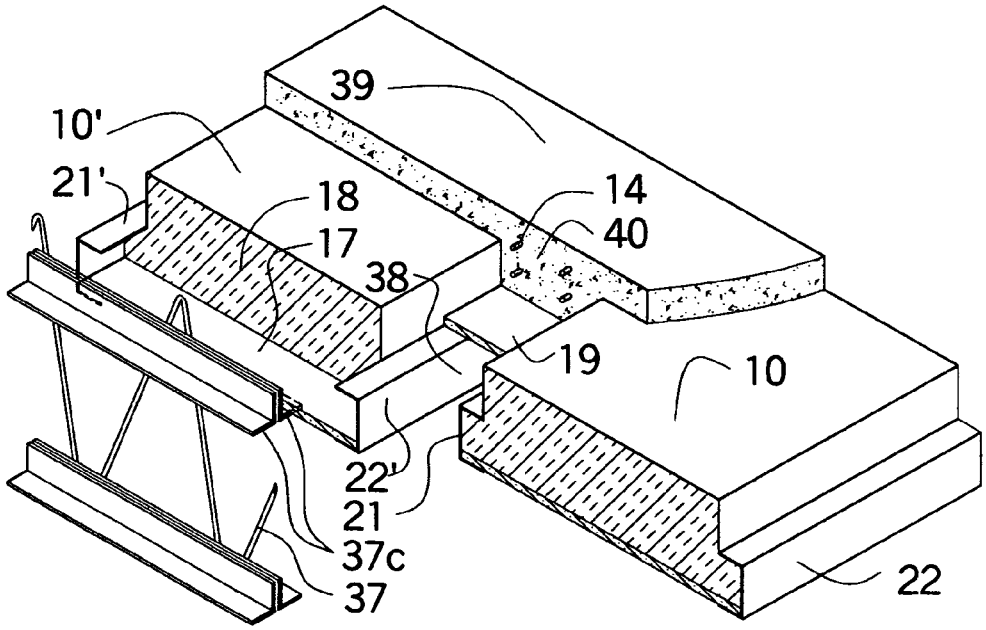
FIG. 10 shows an isometric drawing of the typical concrete ribbed floor where a steel bar joist is used at the transverse beam area.

The same panel molds 10' & 10 from FIG. 9 are used in FIG. 10 except here the panel mold support members shown as C channels 21' & 22' of the panel mold 10' and the C channels 21 & 22 of panel mold 10 (panel mold view cut short) are resting on the top chord 37*c* of the bar joist 37. The mechanical chase 38 below the concrete rib 40, allow the any utilities installed within the mechanical chase to pass through the bar joist 37.

Figure 11:
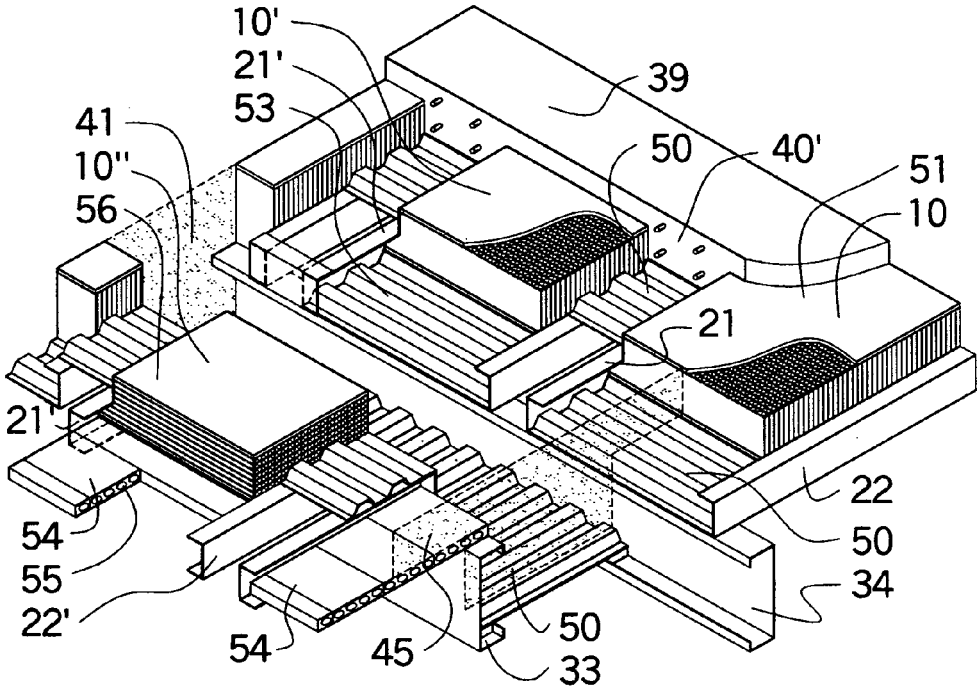
FIG. 11 shows an isometric drawing of the typical concrete ribbed floor and the transverse beam using C channels and different panel mold materials.
Figure 12:
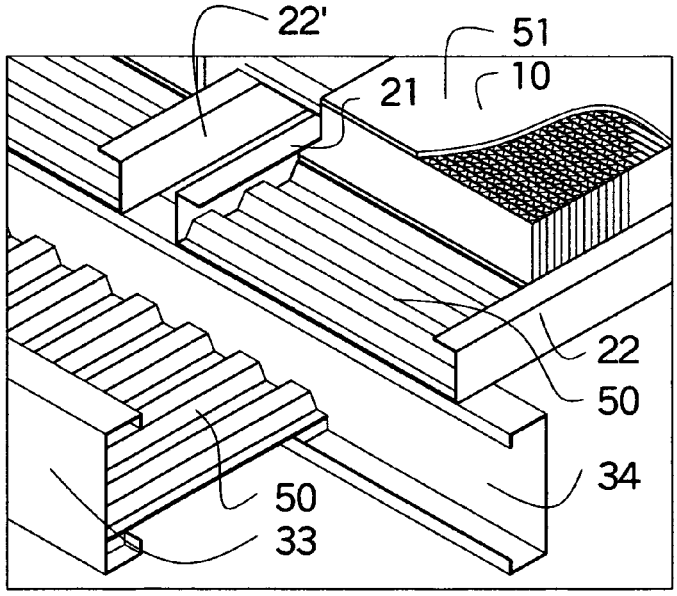
FIG. 12 shows and enlarged drawing area of FIG. 11.

FIG. 11 & FIG. 12 is similar to FIG. 2 except the same panel mold 10 uses the panel mold support member shown as C channels 21 & 22 to support a ribbed fiberboard 50 which is a paper based product rather than a rigid board like drywall or plywood. Above the vertically ribbed fiberboard 51 is a treated fluted skin paper known as corrugated paper. The vertically ribbed corrugated paper 51 is orientated vertically to support the weight of the wet concrete 39 until it cures. The vertical orientation of the ribbed corrugated paper 51 requires the ribbed fiberboard 50 to be stronger. In panel mold 10' the C channels 21' & 22' uses metal corrugated decking 53 to span greater distances in lieu of the fiberboard 41 as described in FIG. 2. Also in panel mold 10" the C channel 21" & 22" has a hybrid natural-fiber composite panel 54 with cellular skeleton tubular openings 55 between the C channels 21" & 22". In lieu of the vertically oriented ribbed fiberboard 51 as shown in panel mold 10, a horizontally oriented ribbed fiberboard 56 is shown in panel mold 10". A concrete rib 40' also uses the ribbed fiberboard 50 between the C channels 22' & 21. The transverse beam 41 shown as shaded and as shown in FIG. 6 is supported by C channels 33 & 34 also has the ribbed fiberboard 50 as the bottom of the transverse beam 41. A transverse beam 45 shown as a ghost outline and highlighted in shading, is shown as a T shaped transverse beam. The top area of the T shape is supported by the ribbed fiberboard 50 on the right side and hybrid natural-fiber composite panel 54 on the left side. By not installing the vertically ribbed fiberboard 51 over the ribbed fiberboard 50, then a T transverse beam can be installed.

Even though these panel molds are shown for a concrete floor system, the molds can also be used as a precast wall system or a precast floor system (where the floor panels are cast in sections). Instead of installing concrete over all the panel molds that comprise a building floor, several panel molds are placed adjacent to one another at the desired width of a precast panel and concrete is installed within the panel mold. When the concrete has cured within the panel mold, the precast panel when installed horizontally will be a precast concrete floor or when installed vertically will be a precast concrete wall. The panel molds are described typically using a metal supports at the sides with rigid board and rigid insulation above. In lieu of the rigid insulation at the panel mold, a single or double faced fiberboard form spacer or even straw can be used to create a support means for the concrete to be installed over.

The invention claimed is:

1. A building floor having a rib formed of poured concrete, the floor consisting of:

a rib form including:

a plurality of panel molds, each panel mold made of insulating material and having two opposing side walls, each side wall having a notch therein;

a panel mold support member attached to each side wall, the panel mold support members having a web and two flanges on opposite ends thereof; and wherein the upper flange of each panel mold support member rests on a notch of the panel mold side wall, and wherein the lower flange of each panel mold support member supports a rigid board;

wherein the rib is formed from concrete poured onto the forms.

2. A building floor according to claim 1, wherein adjacent panel mold members are separated by an air space and are spaced from one another by the rigid board.

3. A building floor according to claim 1, wherein adjacent panel mold members are separated by an air space and are spaced from one another by an upper rigid board resting on the upper flanges of the panel mold members.

4. A building floor according to claim 3, wherein a mechanical chase is formed between the adjacent panel mold members, the rigid board, and the upper rigid board.

5. A building floor according to claim 1, wherein the panel molds are made of rigid insulation.

6. A building floor according to claim 1, wherein the rigid board is permanently installed between the panel mold support members and is made of plywood.

7. A building floor according to claim 1, wherein said rigid board is made of ribbed fiberboard.

8. A building floor according to claim 1, wherein said rigid board is made of a hybrid natural-fiber composite panel with holes.

9. A building floor according to claim 1, wherein said rigid board is made of corrugated metal decking.

10. A building floor according to claim 1, wherein said rigid board is made of fiber cement board.

11. A building floor according to claim 1, wherein the panel mold support members and rigid boards extend the full length of the panel molds.

12. A building floor according to claim 1, further having a transverse beam formed of poured concrete, the floor further consisting of:

a transverse beam form including:

a plurality of beam support members, each beam support member having a web and two flanges on opposite ends thereof; and a plurality of rib boards, each rib board being placed between a pair of beam support members, the rib board being supported by the lower flanges of adjacent beam support members;

wherein the transverse beam is formed from concrete poured onto the forms.

13. A method of making a poured concrete floor comprising:

providing a plurality of panel molds, each panel mold made of insulating material and having two opposing side walls, each side wall having a notch therein;

attaching a panel mold support member to each side wall, the panel mold support members having a web and two flanges on opposite ends thereof;

resting the upper flange of each panel mold support member on a notch of the panel mold side wall;

supporting a rigid board on the lower flange of each panel mold support member;

pouring concrete over the system to form a floor having a concrete rib.

14. A method of making a poured concrete floor according to claim 13, and further comprising:

providing a plurality of beam support members, each beam support member having a web and two flanges on opposite ends thereof;

supporting a plurality of rib boards on the lower flanges of adjacent beam support members, each rib board being placed between a pair of beam support members;

pouring concrete over the system to form a floor having a concrete rib and a transverse concrete beam.

* * * * *